US006668999B2

(12) United States Patent
Ohtomo

(10) Patent No.: US 6,668,999 B2
(45) Date of Patent: Dec. 30, 2003

(54) COIN SENSOR

(75) Inventor: Hiroshi Ohtomo, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 89 days.

(21) Appl. No.: 09/945,091

(22) Filed: Aug. 30, 2001

(65) Prior Publication Data

US 2002/0060123 A1 May 23, 2002

(30) Foreign Application Priority Data

Aug. 30, 2000 (JP) ..... 2000-261111

(51) Int. Cl.[7] ..... G07D 5/08; H01F 27/28

(52) U.S. Cl. ..... 194/318; 194/317; 194/302; 336/225; 73/163

(58) Field of Search ..... 194/317, 318, 194/320, 324, 325, 302, 303, 239; 324/228; 336/225, 227, 232, 233; 73/163

(56) References Cited

U.S. PATENT DOCUMENTS

| | | | | | |
|---|---|---|---|---|---|
| 3,451,130 | A | * | 6/1969 | Ellis | 29/605 |
| 4,184,366 | A | * | 1/1980 | Butler | 73/163 |
| 4,323,148 | A | | 4/1982 | Nichimoto et al. | 194/100 A |
| 4,353,453 | A | * | 10/1982 | Partin et al. | 194/319 |
| 4,361,218 | A | * | 11/1982 | Van Dort | 194/317 |
| 4,371,073 | A | * | 2/1983 | Dubey | 194/334 |
| 4,842,119 | A | * | 6/1989 | Abe | 194/317 |
| 5,078,252 | A | | 1/1992 | Furuya et al. | 194/318 |
| 5,293,980 | A | | 3/1994 | Parker | 194/317 |
| 5,439,089 | A | | 8/1995 | Parker | 194/317 |
| 5,609,234 | A | | 3/1997 | Walker et al. | 194/317 |
| 5,988,348 | A | | 11/1999 | Martin et al. | 194/317 |
| 6,047,808 | A | | 4/2000 | Neubarth et al. | 194/317 |
| 6,056,104 | A | | 5/2000 | Neubarth et al. | 194/317 |
| 6,056,105 | A | * | 5/2000 | Ohtomo | 194/319 |
| 6,098,777 | A | * | 8/2000 | Hoffman et al. | 194/318 |
| 6,196,371 | B1 | | 3/2001 | Martin et al. | 194/317 |
| 6,404,090 | B1 | * | 6/2002 | Phillips et al. | 310/166 |

FOREIGN PATENT DOCUMENTS

| | | | | |
|---|---|---|---|---|
| EP | 0 304 535 A2 | * | 3/1989 | G07F/3/02 |
| GB | 2 055 498 A | * | 3/1981 | G07D/5/08 |
| JP | 61 177687 A | | 12/1986 | G07D/5/08 |
| JP | 2-71393 A | * | 3/1990 | G07D/5/08 |

* cited by examiner

*Primary Examiner*—Donald P. Walsh
*Assistant Examiner*—Mark J Beauchaine

(57) ABSTRACT

A coin sensor is provided for more accurately assessing the authenticity of a coin passing through a vertical channel where the channel is sized to accommodate different diameter coins. In the present invention, magnetic coils are deployed on the side of the channel to measure magnetic flux, which is converted to digital signals and compared to stored values to assess the diameter, thickness, and material of the coin. To reduce the tolerances associated with the varying path of the coin, the sensors have been provided with cores having generally straight and parallel upper and lower surfaces aligned perpendicular to the path of the coin to remove the variances in the overlapping coin area as the coin.

14 Claims, 13 Drawing Sheets

COIN SENSOR

BACKGROUND OF THE INVENTION

1. Field of the Invention

The present invention relates generally to coin sensors for validating a coin in a coin accepting machine, such as a vending machine, and more particularly to a sensor for evaluating the diameter of the coin. For purposes of the following disclosures, the term "coin" is used generally to refer to monetary coins, tokens, and the like.

2. Description of the Related Art

A coin sensor and a decision circuit of a coin selector are detailed with reference to FIGS. 18 and 19. The sensor is formed within a body 50 and includes a coin acceptance slot 51 leading to a coin passage 52. The coin passage 52 is comprised of peripheral guidewalls 53, 54 and sideplates 55, 56. The sideplates 55, 56 extend parallel to a diameter of the coin C, and the guidewalls 53, 54 are located at opposed ends of the sideplates as shown in FIG. 19 to form a rectangular profile. A line L illustrating the path of the coin C lies in the vertical direction.

The distance between the peripheral guidewalls and between the sideplates are selected to accommodate several different sizes of coins. Accordingly, the space between the peripheral guidewalls 53, 54 is slightly larger than the largest diameter coin anticipated to be used in the sensor. Similarly, the space between the sideplates 55, 56 is slightly larger than the thickness of the largest coin that is to be used.

A first coin sensor 57 is located on a horizontal line M that intersects the path line L in a perpendicular manner. The coin sensor 57 lies along the coin passage 52 adjacent the sideplate 55. Sensor 57 comprises a wound coil 57C about a cylindrical core 57B. The core 57B is preferably made of a ferromagnetic material, such as ferrite.

A sensor 60 is fixed opposite the sensor 57 on sideplate 56. Sensor 60 comprises a wound coil 60C about a cylindrical core 60B. Another sensor 61 is mounted on the sideplate 55 adjacent the peripheral guidewall 54. The center of sensor 61 is also located on line M. Sensor 61 comprises a wound coil 61C about a cylindrical core 61B. Sensor 62 is mounted opposite sensor 61 at sideplate 56. Sensor 62 comprises a wound coil 62C about a cylindrical core 62B. The sensor pair 57, 60 cooperate to form a coin left end sensor 63 used to determine the relative area of the left end of the portion of coin passing by sensor 63. Similarly, the pair of sensors 61, 62, cooperate to form a coin right end sensor 64 and is used to determine the relative portion of the coin passing by the right end sensor 64.

Sensors 65, 66 lie along path line L and are offset from line M. Sensors 65, 66 are similar in structure to sensor 61 in that each sensor 65, 66 includes a coil 65C, 66C, respectively, wound about a cylindrical core 65B, 66B, respectively. The sensors 65, 66 constitute a material sensor 67 and a thickness sensor 68.

A coil 65D is wound around the outside of coil 65C. The coil 65C is connected to the coil 66C. Similarly, the coil 65D is connected to the coil 66D. The thickness sensor 68 comprises the coil 65C wound about the core 65B. The material sensor 67 comprises the coil 65D and 66D about the respective core 65B and 66B. A beginning end of coil 57C is connected with the termination end of coil 61C. The termination end of coil 57C is connected with the termination end of coil 60C. A starting end of coil 60C is connected with a termination end of coil 62C. A starting end of coil 62C is connected to an oscillation circuit 70, and a starting end of coil 61C is connected to the oscillation circuit 70.

The end of the coil 65C of the thickness sensor 68 is connected to the oscillation circuit 71. A starting end of the coil 65C is connected to the termination end of the coil 66C of the sensor 66. A starting end of the coil 66C is connected to the oscillation circuit 71.

A starting end of the coil 65D of the material sensor 67 is connected to the oscillation circuit 69. A termination end of the coil 65D is connected with the termination end of the coil 66D of sensor 66. A starting end of the coil 66D is connected to the oscillation circuit 69. The oscillation circuit 69 is connected with a detection circuit 72. An oscillation circuit 70 is connected to a detection circuit 73. The oscillation circuit 71 is connected with the detection circuit 74.

The detection circuits 72, 73, 74 are respectively connected to a control circuit through AD connection circuits 76, 75, 77. The control circuit comprises a microprocessor 78. The unit also includes a reject board 80 which obliquely crosses the path line L of the coin passage 52.

The coin C is deflected by the reject board 80 when the reject board 80 protrudes in the pathway defined by the coin passage 52. A coin return (not shown) is found at the end of the rejection passage 81.

The movement of the reject board 80 is controlled by a spring (not shown) generally, which biases the position of the reject board 80 into and out of the pathway of the coin passage 52. The control is governed by a solenoid 82 excited by the signal of the microprocessor 78, when the microprocessor determines that the coin is unacceptable. By the excitation of the solenoid 82, the reject board 80 is withdrawn from the coin passage 52 when it is determined that the coin is acceptable. In this case, the coin falls past the reject board 80 into a coin collection unit (not shown).

The foregoing describes a coin sensor which may be used, for example, in a vending machine. A coin C dropped into the receiving slot of a vending machine reaches the coin passage 52. As the coin falls vertically, the coin passes left end sensor 63 and right end sensor 64 to varying extents depending on the path of the coin, i.e., whether the coin falls down the center or toward one side. As the coin passes the sensors, a high frequency is applied from the oscillation circuit 70 to the coil 57C and 60C of the left end sensor 63 and the coil 61C and 62C of the right end sensor 64. A resultant magnetic flux is generated at the cores 57B, 60B, 61B and 62B. The magnetic flux from each core extends into the coin passage 52. Eddy currents are generated in the coin C when the coin (an electrical conductor) passes through these magnetic flux. As a result, the magnetic flux of the coils 57C, 60C, 61C and 62C are reduced.

The loss of flux due to the passing of the coin causes a change in the output of the oscillation circuit 70. The flux loss is proportional to the relative area of the coin C adjacent the respective cores 57B, 60B, and 61B, 62B. The detection circuit 72 converts an output of the oscillation circuit into a voltage. The AD conversion circuit 75 output of the detection circuit 73 is converted into a digital value that is transmitted to microprocessor 78.

Similarly, a magnetic flux arising in the coil 65C at the core 65B is affected by the thickness of the coin C. A magnetic flux arising from the coil 66C at the core 66B is affected by the thickness of the coin C. As a result, an output of oscillation circuit 71 changes. The digital circuit 74 converts an output of the oscillation circuit 71 into a voltage. The AD conversion circuit 77 output of the detection circuit 74 is converted into a digital value, and is transmitted to the microprocessor 78.

A magnetic flux generated by the coil 65D at core 65B is affected by the material at the interior of the coin C. Similarly, a magnetic flux generated by the coil 66D at the core 66B is affected by the material at the interior of the coin C. As a result, the output of the oscillation circuit 69 varies. The detection circuit 72 converts an output of the oscillation circuit 69 into a voltage. The AD conversion circuit 76 output of the detection circuit 72 is converted into a digital value, and it is transmitted to the microprocessor 78.

The microprocessor 78 determines whether the coin C is of a particular acceptable diameter based on information stored in the memory 83. That is, the voltage from the AD conversion circuit 75 is compared with a reference value to a known diameter coin determined beforehand and stored in the memory. The microprocessor 78 also distinguishes whether the material in the coin C is an acceptable material based on stored values. The voltage from the AD conversion circuit 76 is compared with reference values stored in memory 83 to evaluate the material. A microprocessor 78 also distinguishes whether the thickness of the coin C, based on the voltage from the AD conversion circuit 77, is acceptable compared with reference values stored in memory 83.

When the microprocessor 78 determines that the diameter, material, and thickness of the coin C is acceptable, the microprocessor 78 excites the solenoid 82. This excitation causes the reject board 80 to be withdrawn from the coin passage 52 such that the coin can fall into the retention reservoir (not shown).

If the microprocessor determines that there is a deviation in the acceptable thickness material, or diameter from the provided reference values, then the solenoid 82 is not excited. The rejection board 80 remains in the pathway between the coin passage 52 and the retention reservoir. The coin is thus deflected by the rejection board 80 into the cancellation passage 81, where it is led to a coin return.

The width W (FIG. 18) of the coin passage 52 is selected to accommodate coins of various types. To accomplish this, the width is selected to be slightly bigger than the diameter of the largest coin anticipated to be used with the coin selector. As a result, the position of the coin passing along the coin passage 52 is unknown beforehand.

For example, consider the case in which the coin C having the diameter shown in FIG. 20A travels along the central portion of the coin passage 52 as shown. At the point at which the coin falls directly and equally between the two sensors, the coin covers more than three quarters of the circular areas of cores 61B, 62B and of cores 57B, 60B. The covered portion of the two sensors is indicated by the hatched region, and the uncovered portion of the core's areas are unhatched.

In the case illustrated in FIG. 20B, the coin passes closer to the sensors 57, 60, than the sensors 61, 62. In this case, the cores 57B, 60B are almost completely covered by the coin C, whereas about half of the cores 61B, 62B are covered by the coin C. As a result, the relative area for the coin C covering the portion of core 61B, 62B is decreased in comparison with the first case shown in FIG. 20A. To compare the areas left uncovered between FIG. 20A and FIG. 20B, the two slices of area from FIG. 20A is superimposed over the uncovered area of FIG. 20B in cross hatching. The difference in the total area left uncovered by the coin in FIG. 20B can be seen to be greater than the area left uncovered in FIG. 20A.

As a result, the output of the detection circuit 73 becomes line v, as it is shown in FIG. 21 when the coin falls to the left as shown in FIG. 20B. When the coin falls down the center of the passage 52, the output of the detection circuit 73 is shown by line V, and $\Delta V1$ is the voltage difference between the two cases. In FIG. 22, a similar case in which a smaller coin is explained with the same conditions as FIG. 20.

In the case in which the small coin c falls to the left of the passageway as shown in FIG. 22B, the relative area of the cores 57B, 60B, and 61B, 62B covered up by the coin C increase and decrease, respectively, in comparison with the case in which the coin falls directly down the middle as shown in FIG. 22A. The superimposed cross-hatched area in FIG. 22B from the areas of coverage in FIG. 20A illustrates the difference between the two cases.

As a result, the voltage is shown by line Y in FIG. 23 when the coin falls to the left side as shown in FIG. 22B. The voltage is shown by line y when the coin falls down the center of the passage 52, and $\Delta V2$ is the voltage difference between the two cases. The potential difference of $\Delta V1$ and $\Delta V2$ arises from the size of the coin and the path that the coin travels down the passage.

This tolerance associated with the voltage as a result of the path taken by the coin makes the threshold determination of the coin's verification difficult. That is, the evaluation that determines an acceptable coin as compared with a unacceptable coin is improved when the tolerance of $\Delta V$ is small. Conversely, the rate at which the sensor incorrectly judges the authenticity of the coin increases when the tolerance is large.

SUMMARY OF THE INVENTION

The purpose of the present invention is to improve the selection performance of the coin sensor. This is achieved by the present invention in which the output of the sensor does not change regardless of the passage that the coin travels through the passageway.

To achieve this objective, the coin selector of the present invention comprises a coin passage for guiding a coin, a first sensor and a second sensor adjacent the coin passage, both the first sensor and second sensor comprising a coil wound about a core, where the core of the first and second sensor is shaped to have substantially straight and parallel upper and lower boundaries, such as a rectangle or square.

It is preferable that the coin passage is vertically oriented. In the present invention, it is preferable that the coin passes the core of the sensors such that the sensor reads the width of the coin. In reading the width of the coin, the area difference by the curvature of the circular arc of the coin is small. This allows for a common discrimination standard among multiple coins.

Also in a preferred embodiment of the present invention, a coin passage in which a coin is guided includes a first sensor and a second sensor which are adjacent the coin passage, said first coin sensor laterally offset of the center of the coin passage, a third coin sensor that is located opposite the first coin sensor, said second coin sensor laterally offset from the center of the coin passage, a fourth coin sensor that is located opposite the second coin sensor, where the first, second, third and fourth coin sensors are each comprised of a coil wound about a core in the shape of a rectangle when viewed from the coin passage.

When the coin passes the cores of the previously described sensors, an equal voltage output is derived, regardless of the passage path that the coin takes. Therefore, the detection accuracy of the coin is improved.

BRIEF DESCRIPTION OF THE DRAWINGS

The exact nature of this invention, as well as its objects and advantages, will become readily apparent upon reference to the following detailed description when considered in conjunction with the accompanied drawings, in which like reference numerals designate like parts through the figures thereof, and wherein.

DESCRIPTION OF THE PREFERRED EMBODIMENTS

The following description is provided to enable any person skilled in the art to make and use the invention and sets forth the best modes contemplated by the inventors of carrying out his invention. Various modifications, however, will remain readily apparent to those skilled in the art, since general principles of the present invention have been defined herein specifically to provide a coin detecting mechanism.

Figure 1:
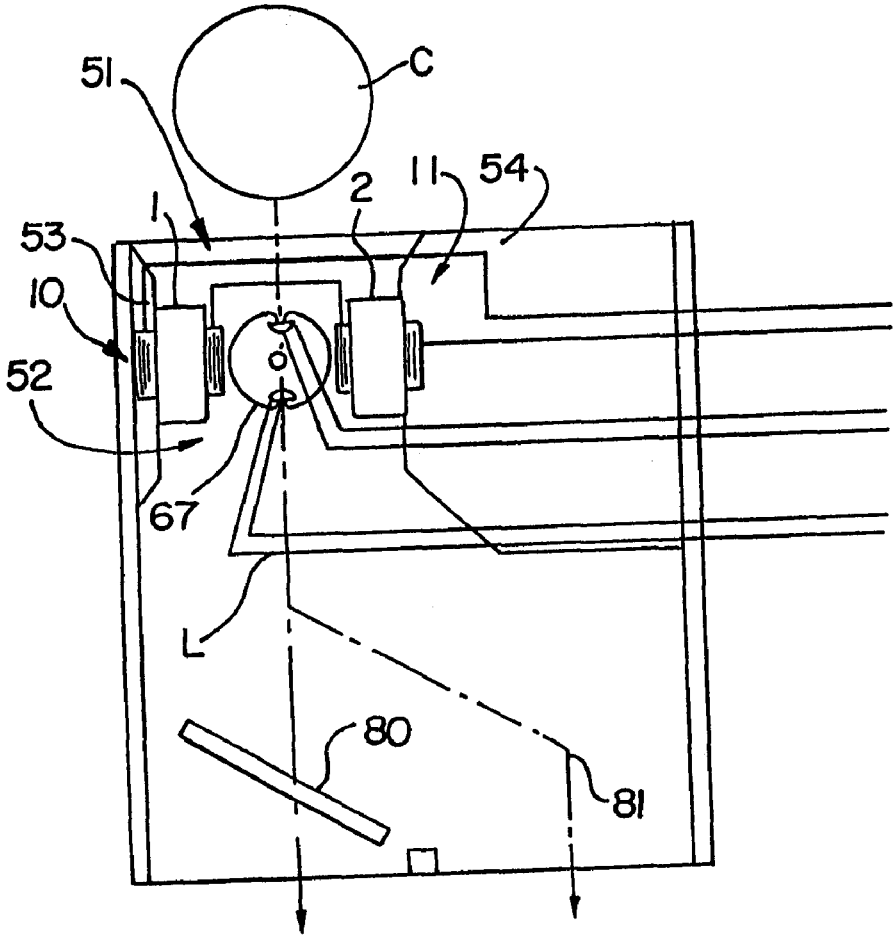
FIG. 1 is a schematic diagram of a first embodiment.
Figure 5:
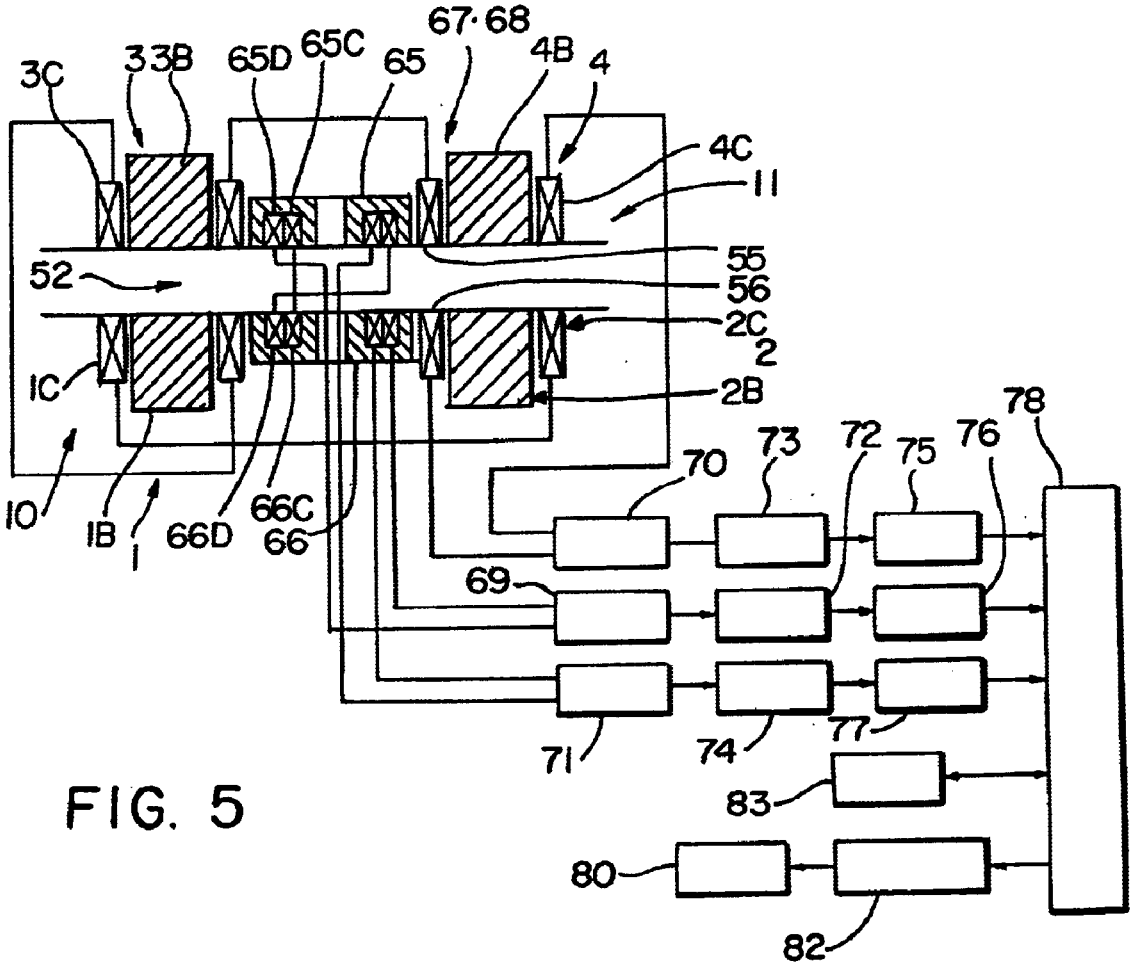
FIG. 5 is a explanatory circuit drawing of the first embodiment.

In FIGS. 1 and 5, sensors 1, 2, 3, and 4 are the sensors which concern the present invention. Each of the sensors 1, 2, 3, and 4 are identical in structure. FIG. 1 is explained for illustrative purposes, and the remaining sensors include like designations appended by common letters of the alphabet to indicate common elements.

Figure 2:
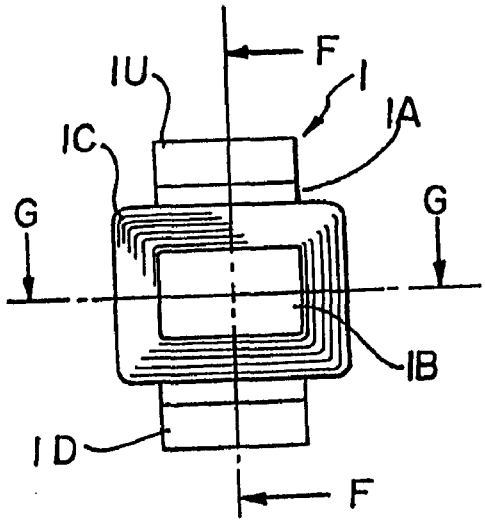
FIG. 2 is a plan view of a coin sensor of the first embodiment.
Figure 3:
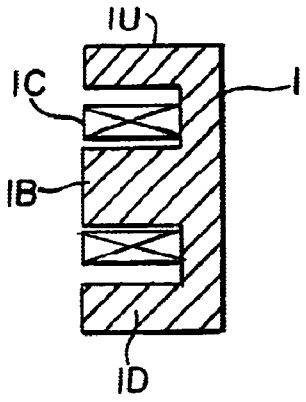
FIG. 3 is the sectional view of FIG. 2 along line F—F.
Figure 4:
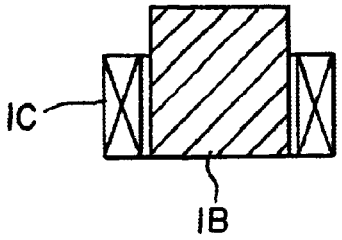
FIG. 4 is a sectional view of the embodiment in FIG. 2 along section line G—G.

In FIG. 2, the main body of sensor 1 is formed of a ferromagnetic material such as ferrite. The cross-section of the main body 1A is in the shape of an "E" as shown in FIG. 3. The face which is opposite to the coin passage 52 is a rectangle on the core 1B which projects from the center of the main body 1A as shown in FIGS. 2 and 3.

A copper wire is wound about the core 1B forming a coil 1C. The coil 1C may be circular. However, the efficiency of the magnetic flux generation is increased in the case where the coil 1C conforms with the circumference of the core 1B. An upper magnetic flux wall 1U projects above the core 1B, and a lower magnetic flux wall 1D projects beneath the core 1B.

The sensor 1 is placed at the right end of the coin passage 52 as it is shown in FIGS. 1 and 5. The end face of the core 1B, the upper magnetic flux wall 1U, and the lower magnetic flux wall 1D each oppose the coin passage 52 at sidewall 56.

With respect to the coin passage 52, sensor 3 is opposite sensor 1. The end face of core 3B is disposed at the sidewall 55 in a position opposite the core 1B. Combined, sensors 1 and 3 constitute the coin left end sensor.

Sensor 2 is located at the right end of the coin passage 52. The end face of the core 2B faces the coin passage 52, and is disposed at the sidewall 56. Sensor 4 is positioned across the coin passage 52 opposite the sensor 2. The end face of core 4B is in contact with the sidewall 55. Sensors 2 and 4 constitute the coin right end sensor.

The starting end of the coil 2C of the sensor 2 is connected to the oscillation circuit 70. The termination end of the coil 2C is connected with the starting end of the coil 1C of the sensor 1. The termination of the coil 1C is connected with the termination of the coil 3C of the sensor 3.

The starting end of the coil 3C is connected with the termination of the coil 4C of the sensor 4. The starting end of the coil 4C is connected to the oscillation circuit 70.

Sensor 66 is placed in between sensor 1 and sensor 2. Sensor 65 is placed in between sensor 2 and sensor 4.

The connection of the coil 66C, 66D, 65C, and 65D is similar to that described above with respect to the prior art. The connection between the coil 66C, 66D, 65C, 65D, and the oscillation circuits 69, 71, are also similar to that shown with respect to the prior art.

Figure 6A:
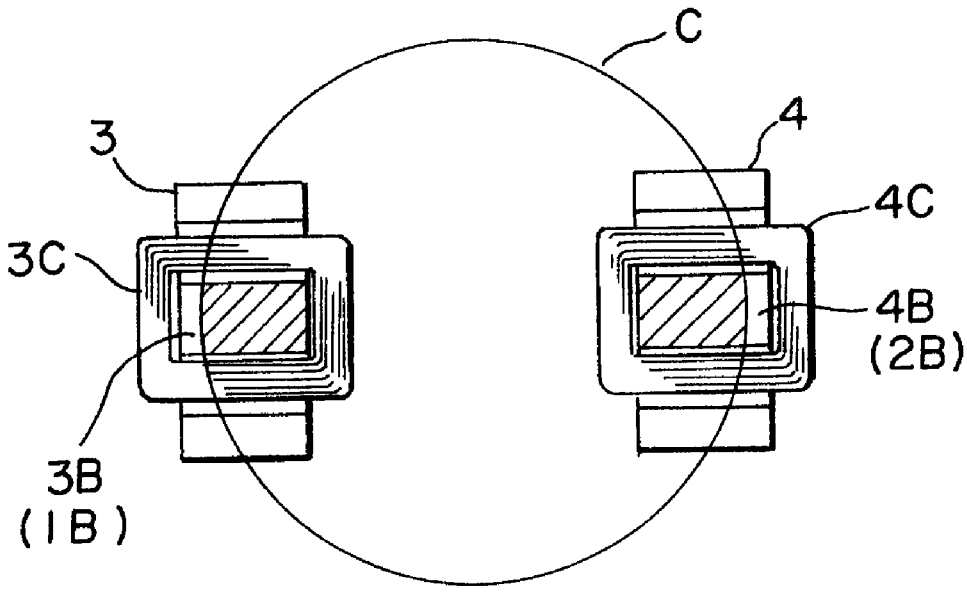
FIG. 6 is a diagram illustrating the various passages of a large diameter coin across the sensors of the present invention.

The movement of the coin with respect to the sensors are now explained with reference to FIGS. 6–8. FIG. 6 shows the relative position of the coin C with the core 3B (1B) and 4B (2B) with the large diameter coin C. FIG. 6A is the relative position of the coin as it passes down the central portion of the coin passage 52. The portion of the sensors uncovered by the coin as it passes the sensors are shown by the unhatched areas.

Figure 6B:
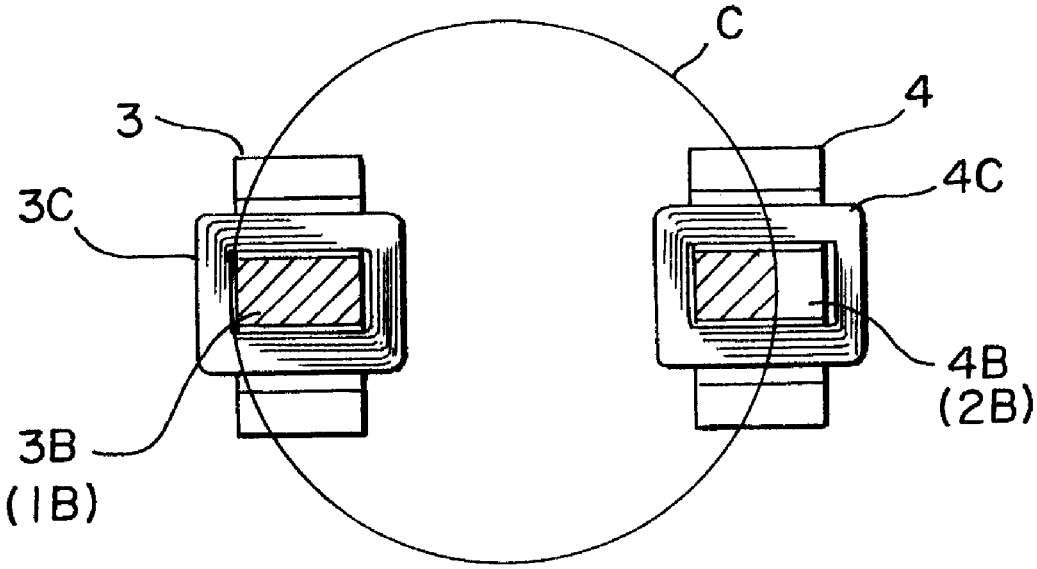

FIG. 6B is a relative position between the coin C and the core 3B (1B), 4B (2B) as the coin C passes along the left end of the passage 52. The hatching of the core 3B (1B) and 4B (2B) shows the area adjacent the coin C.

FIG. 7 is a similar illustration using the small diameter coin.

Figure 7A:
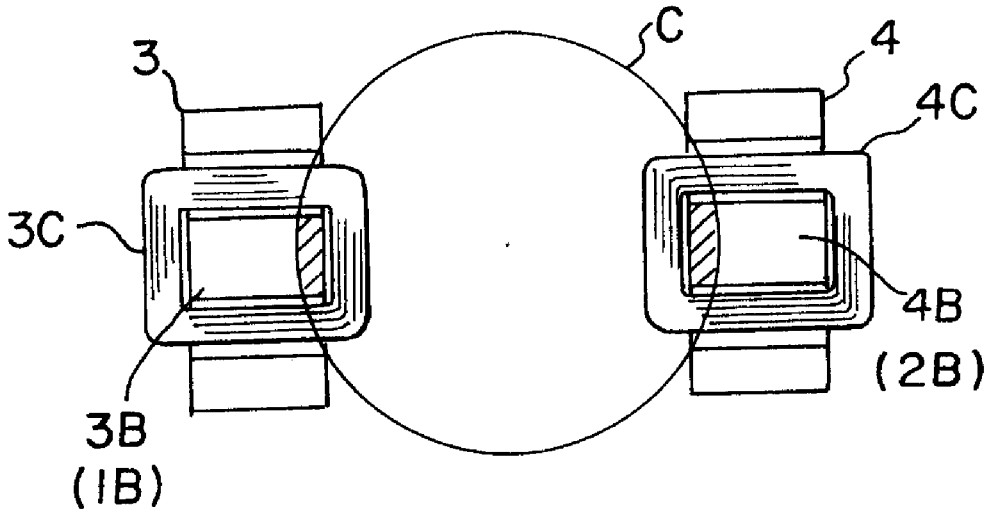
FIG. 7 is a diagram illustrating the various passages of a small diameter coin across the sensors of the present invention.

FIG. 8 illustrates the relative areas of the coin C as perceived by the core 3B and 4B in the first embodiment. With the shape of the cores in a rectangular arrangement, the height "y" of the core 3B and 4B is substantially fixed. The width of the coin C overlapping the core 3B and 4B is identical "a" when the coin C passes down the center of the coin passage 52 as shown in FIG. 6A and FIG. 7A.

Figure 7B:
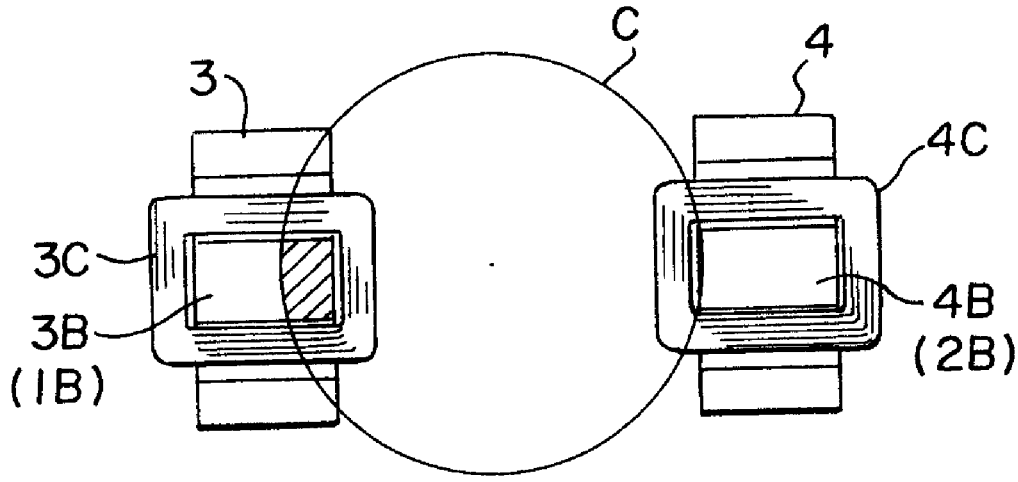
Figure 8A:
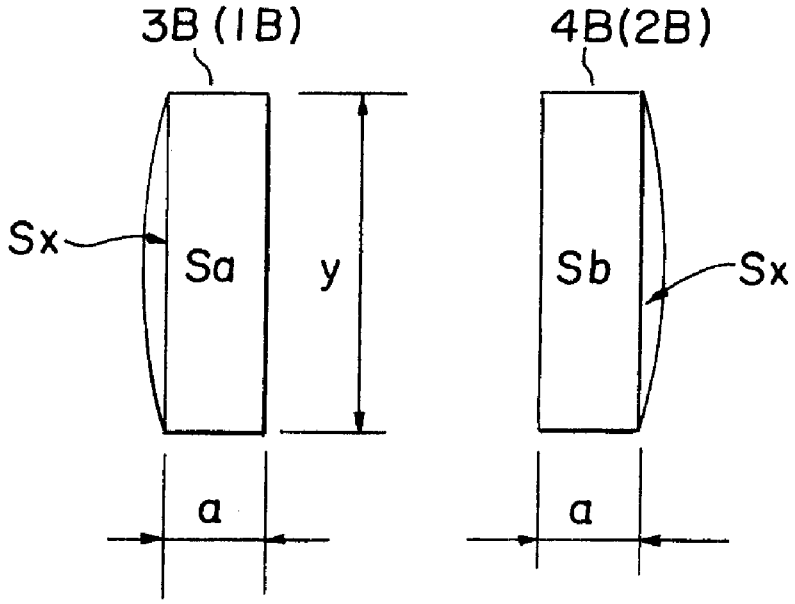
FIG. 8 is an illustration of the cross-sectional area perceived by the sensors for two conditions.
Figure 8B:
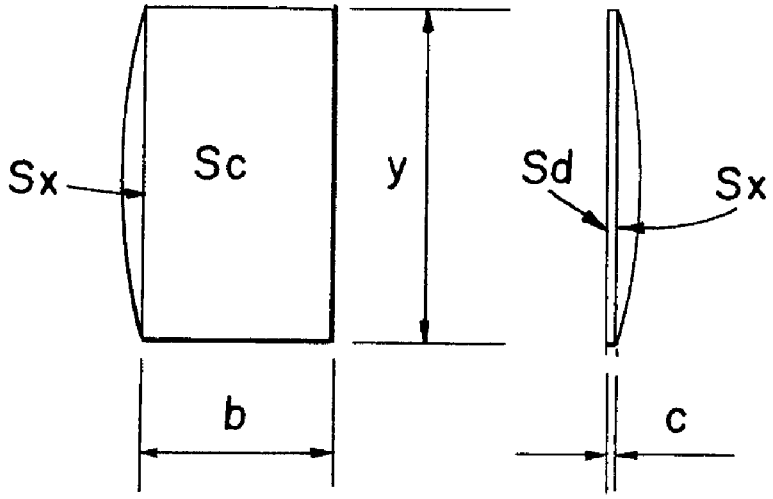

The overlap of the coin C with the core of the sensors 3B, 4B, can be characterized as shown in FIG. 8A, 8B, as a rectangular portion and a rounded tip portion. This corresponds to the cross-hatched regions in FIGS. 6 and 7. Because the radius of the coin is unchanged, the rounded tip portion of the overlap is constant for sensors 3 and 4, regardless of the path that the coin takes. Only the relative rectangular regions Sa, Sb, vary according to the path of the coin. Pursuant to FIG. 8A, when the coin travels down the middle of the passage, the respective portions of the coin seen by sensors 3 and 4 are identical. That is, rounded tip portion Sx is common for both sensors 3 and 4, and rectangular portions Sa and Sb are identical in this case. The largest area of overlap of the coin with the combined areas of cores 3B and 4B of sensors 3, 4, respectively, is given by the expression 1 for the case where the coin passes down the center of the passage 52:

$$S1=Sa+Sb+2Sx=2ay+2Sx. \quad \text{(Expression 1)}$$

FIG. 8B represents the case where the coin passes down the left hand side of the coin passage 52. The relative width of the area between the coin and the core 3B, excluding the rounded tip portion Sx, is denoted "B" when the coin passes down the left hand side of the coin passage as shown in FIGS. 6(B), 7(B). The relative width of the overlap of the coin with sensor core 4B is denoted by the letter "C". Accordingly, the total area of overlap of the core 4B is given by Expression 2:

$$S2=Sc+Sd+2Sx=by+cy+2Sx. \quad \text{(Expression 2)}$$

However, the width is $$2a=b+c \quad \text{(Expression 3)}$$

because the diameter of the coin is identical. Therefore, $$by+cy=2ay \quad \text{(Expression 4).}$$

Therefore, S1=2ay+2Sx=by+cy+2Sx=S2. This illustrates that the overlap of the coin with the sensor core 3B and the sensor core 4B is unchanging regardless of the path of the coin down the coin passage.

The sum of the relative areas of the coin overlap with the two cores does not change regardless of the path taken by the coin down the coin passage. This phenomena is a result of the shape of the core which is opposite to the coin. The use of rectangle for the sensor core shape fixes the output voltage of the detection circuit.

Figure 9A:
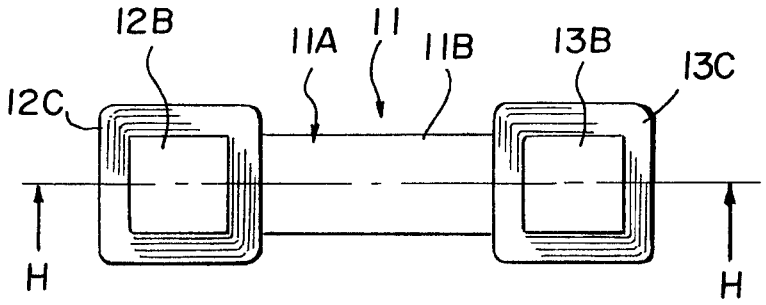
FIGS. 9–11 are second, third, and fourth embodiments of the coin sensor of the present invention.
Figure 9B:
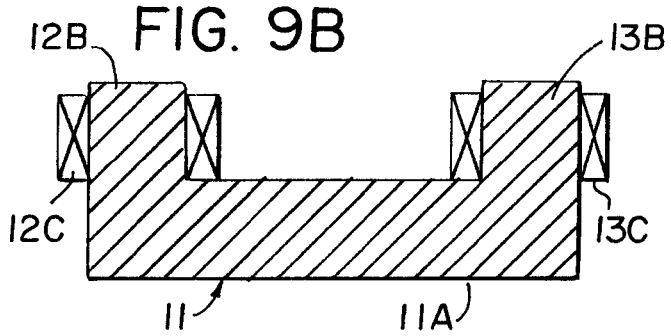

FIG. 9 is a second embodiment of the present invention. A plan view as shown in FIG. 9A illustrates a U-shaped core main body 11A of a sensor 11 having a cross-sectional area in the shape of a rectangle. A sectional view of FIG. 9A taken along section lines H—H in FIG. 9B shows a double core sensor. Along the left end of the main body is a core 12B with a coil 12C wrapped around its circumference. The right side of the main body has a core 13B with a coil 13C wrapped around its circumference. In a preferred embodiment, the coils 12B and 13B are connected.

In this embodiment, a second sensor opposed to the sensor shown in FIGS. 9A, 9B would be disposed across the coin passage, and cooperate with sensor 11. The end faces for the core 12B and 13B is a rectangle in this embodiment. Because the core 12A and core 13B are integrated, the overlapping of the coin's two cores remains constant, regardless of the position of the coin within the coin passage 52. The feature whereby the coils 12C, 13C are connected, reduces the labor where two coils must be connected to the sensor output.

Figure 10A:
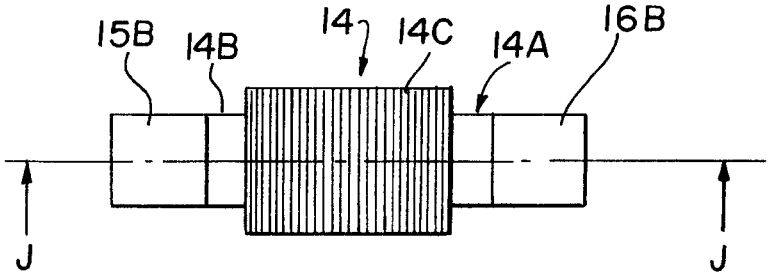

FIG. 10 is a third embodiment of the present invention. In FIG. 10A, a plan view shows that the core main body 14A is identical with the core main body 11 of the previous embodiment shown in FIG. 9. Again, the core main body 14A has a rectangular cross-section.

Figure 10B:
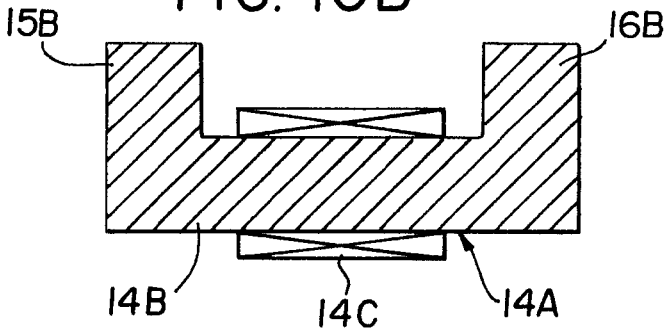

FIG. 10B is a sectional view of FIG. 10A along sectional line J—J. Ends 15B and 16B of the core main body 14A, which are connected to the central portion 14B, adjoin the coin passage 52 at the sides. Here the coil 14C has been wound around the central portion 14B. In this embodiment, a single coil is used which reduces the cost to manufacture the sensor.

Figure 11A:
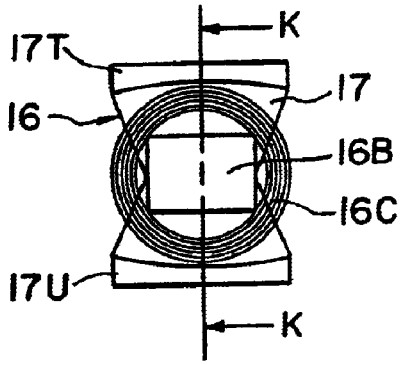
Figure 11B:
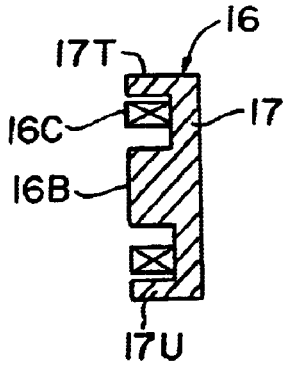
Figure 12:
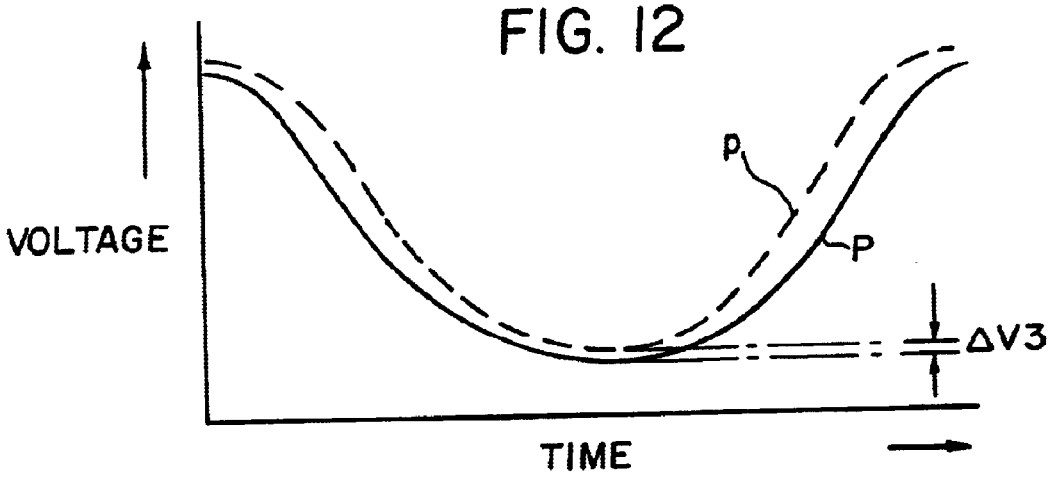
FIGS. 12 and 13 are voltage graphs for a large diameter coin and a small diameter coin, respectively, using the coin sensor of the fourth embodiment in FIG. 11.

FIG. 11 is a fourth embodiment of the present invention. Sensor 16 has an E-shaped profile with a rectangular core 16B as shown in FIG. 11A. The sides of the core 16B are somewhat convex. However, the end face of the core 16B is substantially a rectangle. The upper edge of the main body 17 forms an upper magnetic flux wall 17T. The lower edge of the substrate 17 forms a lower magnetic flux wall 17U. The coil 16C is wrapped around the core 16B in a circular pattern. Alternatively, if the coil 16C is wrapped tightly around the core 16B, it will form a more rectangular pattern. Substituting sensor 16 in place of sensors 1, 2, 3, 4 in the first embodiment results in an output voltage of the detector circuit 72 as shown in FIG. 12. "P" represents the case of the large diameter coin passing down the central portion of the coin passage. "p" represents the case where the large diameter coin passes along the left end.

Figure 13:
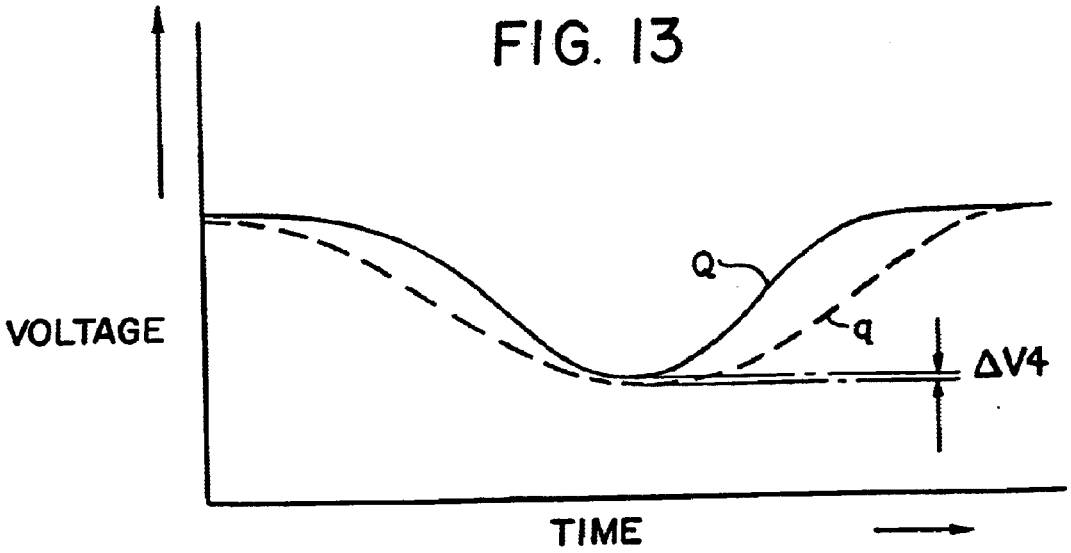

A voltage difference of ΔV3 results between the two outputs depending on the path of the coin. FIG. 13 is an output voltage of the detection circuit 72 using the small diameter coin. Here, when the small diameter coin passes through the center of the coin passage 52, the output of the detection circuit is shown by "Q" whereas the output of the coin passing down the side of the coin passage 52 is shown by "q". A voltage difference between the two curves is given by ΔV4. Note, ΔV3 and ΔV4 are much smaller in magnitude than the case of the prior art sensors using a circular core.

As the cross-sectional area of core 16B increases from a rectangular area to a circular area, the voltage differences of ΔV3 and ΔV4 increases. That is, there is a difference at the relative area of the coin for the pair of sensors as the cores become more rounded.

Figure 14:
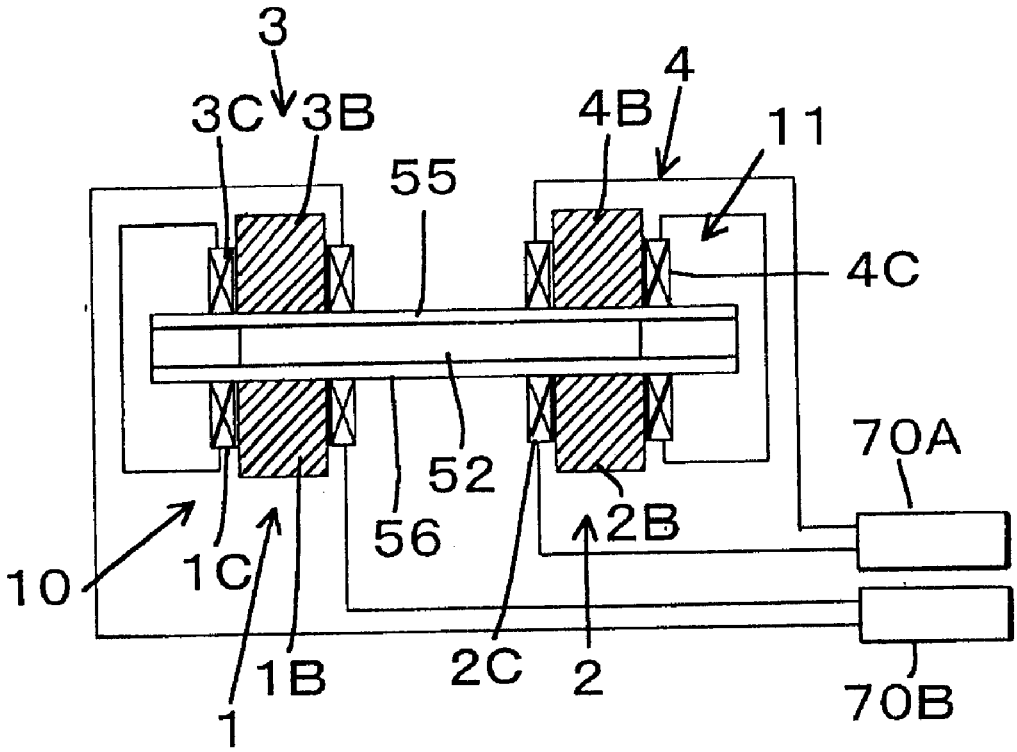
FIGS. 14–17 are examples of coil connections of the coin sensor of the present invention.

FIG. 14 is a alternative embodiment of the coil connection. The starting end of coil 1C of the sensor 1 constitutes the left end sensor 10 which is connected with the termination end of the coil 3C of sensor 3. The starting end of the coil 3C is connected to the oscillation circuit 70B. The termination end of the coil 1C is connected to the oscillation circuit 70B.

The termination end of the coil 2C of sensor 2 which constitutes the right end sensor 11 is connected with the starting end of the coil 4C of sensor 4. The starting end of coil 2C and the termination end of coil 4C are connected with the oscillation circuit 70A. This embodiment combines the output of the oscillation circuit 70A and 70B, and it distinguishes the coin's diameter. This embodiment varies the oscillation circuit 70A and 70B in proportion with the left end sensor 10 and the right end sensor 11. In this manner, the detection accuracy can be improved because the fluctuation of the relative area ratio rate of the coin for each of the cores 1B, 2B, 3B, 4B can be increased.

Figure 15:
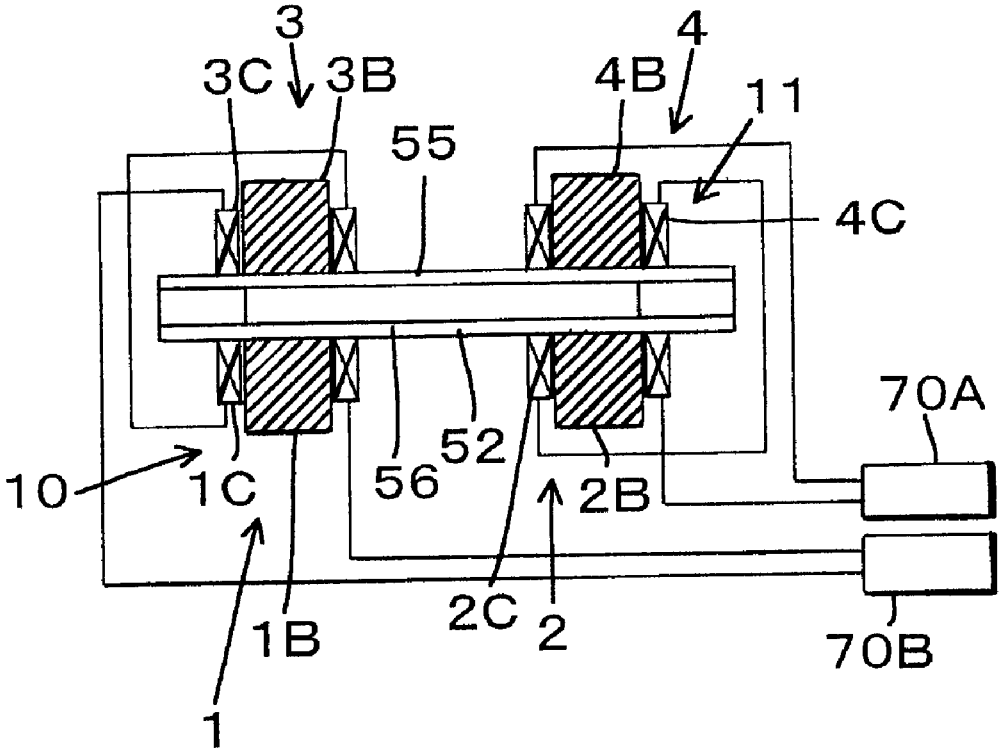

FIG. 15 is an alternative embodiment of the oscillation circuit. Here the connection of the coils 1C, 2C, 3C and 4C is separate. That is, the starting end of the coil 1C is connected with the starting end of the coil 3C. The termination of coil 1C and the termination of coil 3C were connected to the oscillation circuit 70B. The starting end of the coil 2C is connected to the termination end of the coil 4C. The termination of the coil 2C and the termination of the coil 4C are connected to the oscillation circuit 70A.

Figure 16:
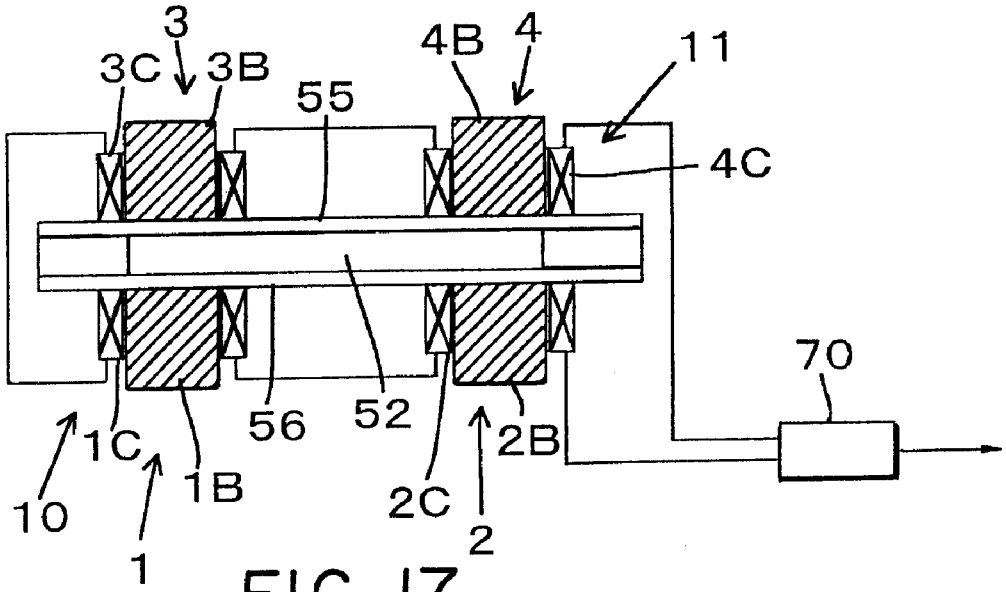

FIG. 16 is an alternate embodiment connection using a single oscillation circuit 70. The termination of coil 2C and the starting end of coil 4C are connected with the oscillation circuit 70. The starting end of the coil 2C is connected with the termination end of coil 1C. The starting end of the coil 1C is connected with the termination of the coil 3C. The starting end of the coil 3C is connected to the termination end of the coil 4C. Using this connection, a similar result to the first embodiment is obtained.

Figure 17:
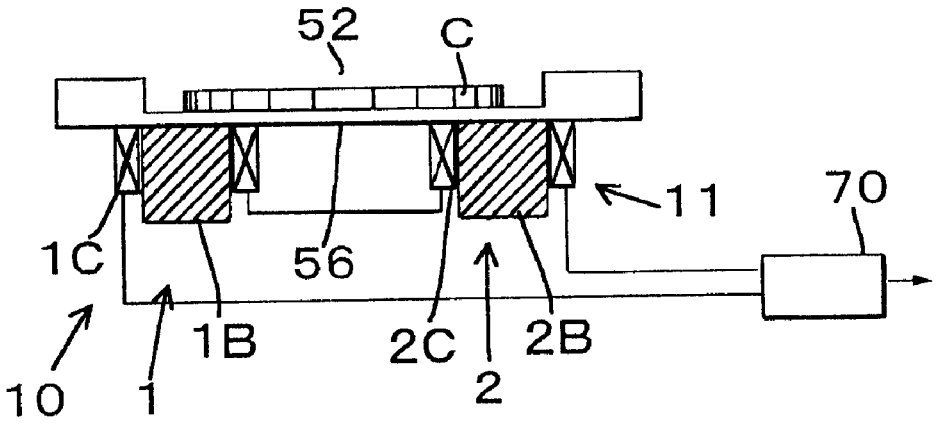
Figure 18:
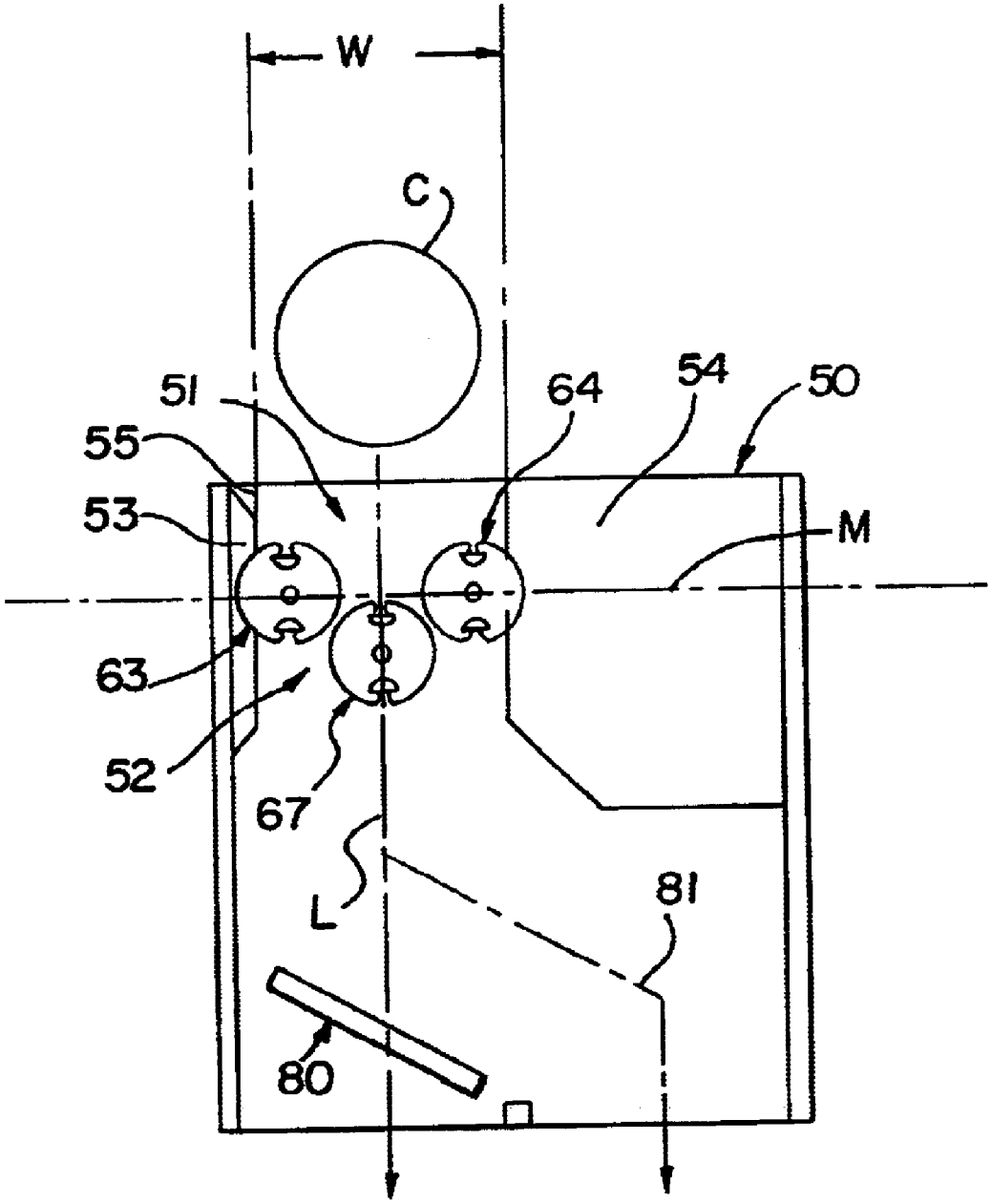
FIGS. 18–23 illustrate the operation and problems of prior art coin sensors.
Figure 19:
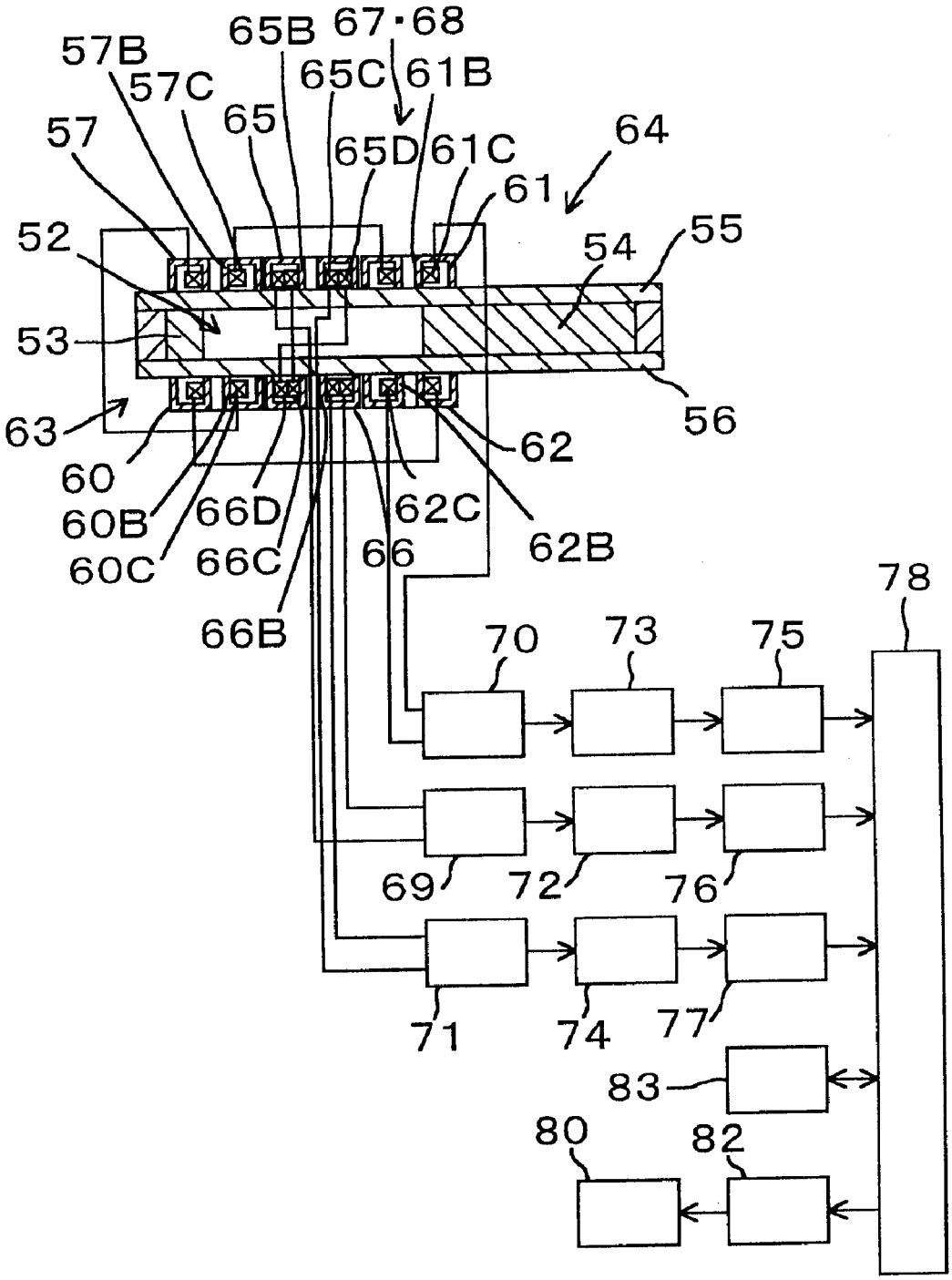
Figure 20A:
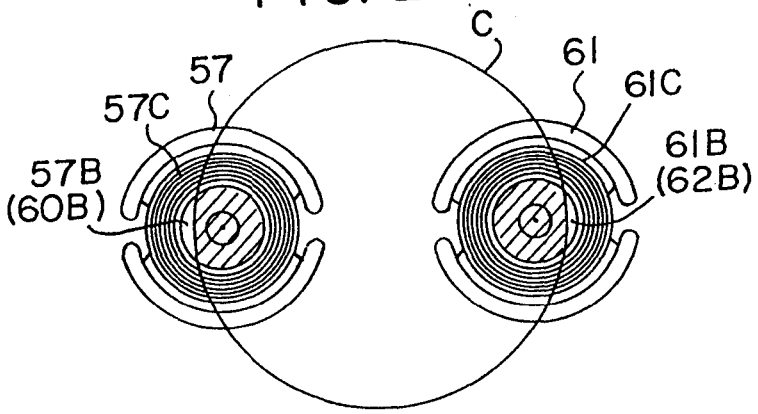
FIG. 20A (PRIOR ART)
Figure 20B:
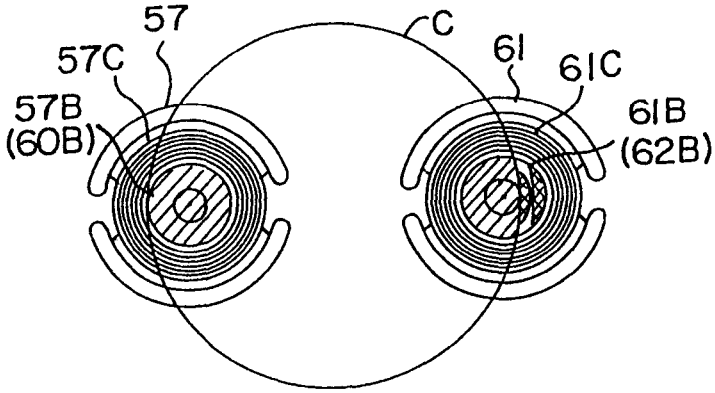
FIG. 20B (PRIOR ART)
Figure 21:
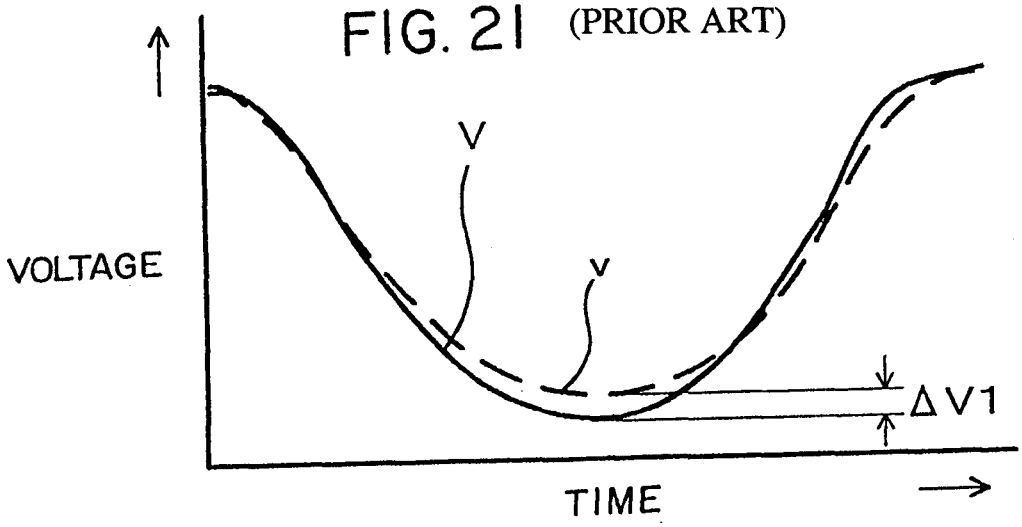
FIG. 21 (PRIOR ART)
Figure 22A:
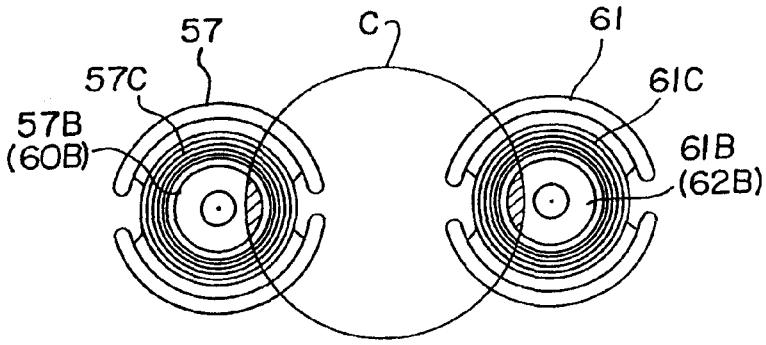
FIG. 22A (PRIOR ART)
Figure 22B:
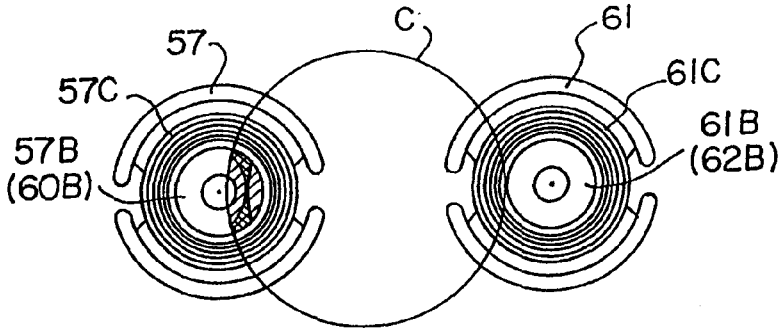
FIG. 22B (PRIOR ART)
Figure 23:
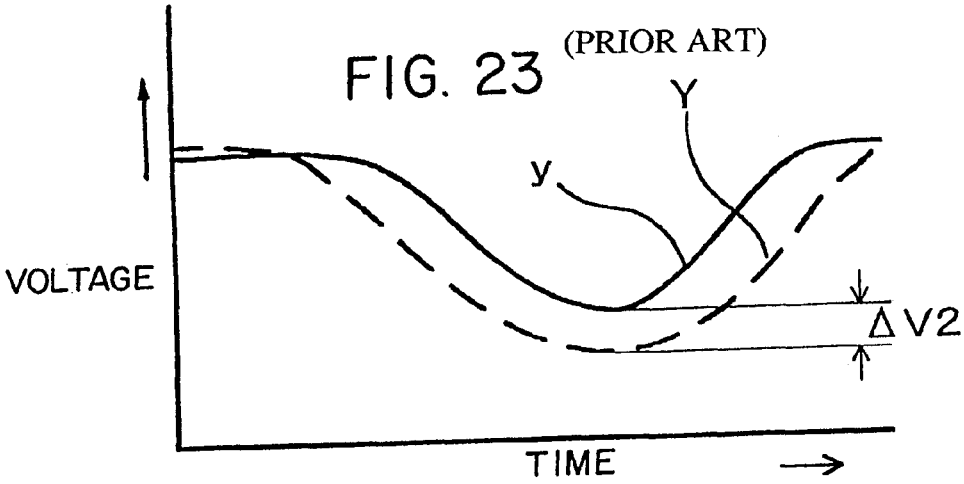
FIG. 23 (PRIOR ART)

FIG. 17 is yet another embodiment of a connection for the present invention. Sensors 1, 2 are located at the sidewall 56. An output of the oscillation circuit 70 changes by the distance between the cores 1B, 2B and the coin C, when there is a single sensor (i.e., no sensor on the opposite side of the coin passage). Therefore, the distance between the coin C and the core 1B, 2B must be fixed.

Therefore, the sidewall 56 is inclined so that the coin C may rest on the sidewall 56. The configuration of sensor 1, 2 is otherwise identical with other embodiment. The termination of the coil 2C and the termination of the coil C are connected with the oscillation circuit 70. The starting end of the coil 1C is connected with the starting end of the coil 2C. This embodiment reduces costs because sensors are located at only one side of the coin passage.

What is claimed is:

1. A coin sensor comprising:

a coin passage for guiding a coin; and a first sensor and a second sensor which adjoin said coin passage and are positioned at right angles to the coin passage to sense opposite edges of a coin, said first sensor and said second sensor each comprising a coil wound about a core and characterized in that said core has a shape at the coin passage including substantially straight and substantially parallel upper and lower boundaries.

2. The coin sensor of claim 1 wherein, the coin passage is vertically inclined to cause coins to move through the passage and across the first and second sensors.

3. The coin sensor of claim 1 wherein the first and second sensors are positioned to detect the diameter of a coin passing through the coin passage.

4. The coin sensor of claim 3 wherein the first and second sensors are positioned to detect the diameter of a plurality of coins and distinguish between different diameters.

5. The coin sensor of claim 1 wherein the first and second sensors generate one or more signals indicative of the diameter of a coin sensed in the coin passage.

6. The coin sensor of claim 1 wherein the first and second sensors each includes a coil core, the length of the coil cores being less than the diameter of coins to be inserted into the coin passage.

7. A core of a coin sensor comprises:

a coin passage for guiding a coin, a first coin sensor and a second coin sensor which adjoin said coin passage, said first coin sensor and said second coin sensor each located on a common side of said coin passage, a third coin sensor and a fourth coin sensor each located on the opposite side of said coin passage from said first and second coin sensors, and aligned respectively with the first and second coin sensors;

said first coin sensor, said second coin sensor, said third coin sensor, and said fourth coin sensor each comprising a wire wound about a core, and characterized in that the shape of each core at an end adjacent to the coin passage is a rectangle.

8. A coin sensing device comprising:

a coin passage for guiding a coin; and a first sensor and a second sensor which adjoin the coin passage and are positioned at right angles to the coin passage, the first sensor and second sensor positioned along opposing edges of the passage, with a separation between the sensors in the middle portion of the passage, to detect the diameter of a coin passing through the coin passage.

9. The coin sensing device of claim 8 wherein the first and second sensors each includes a coil core, the length of the coil cores being less than the diameter of coins to be inserted into the coin passage.

10. The coin sensor of claim 8 wherein the first and second sensors are positioned to detect the diameter of a plurality of coins and distinguish between different diameters.

11. The coin sensor of claim 8 wherein the first and second sensors generate one or more signals indicative of the diameter of a coin sensed in the coin passage.

12. The coin sensor of claim 8 wherein the first and second sensors are positioned along opposing edges of the passage and along the width of the passage.

13. A coin sensing device comprising:

a coin-guiding means with a vertical incline to cause coins to move through a passage; and a first sensing means and a second sensing means which adjoin the coin-guiding means and are positioned at right angles to the passage, the first sensing means and second sensing means positioned along opposing the edges of the passage to detect the diameter of a coin passing through the coin passage.

14. The coin sensing device of claim 13 wherein the first and second sensing means each includes a coil core, the length of the coil cores being less than the diameter of coins to be inserted into the passage.

* * * * *